United States Patent [19]

Barlow et al.

[11] 3,938,586

[45] Feb. 17, 1976

[54] SWINGABLE ROTARY SCREEN

[75] Inventors: G. Benjamin Barlow, East Moline; Chester G. Wolfe, Moline, both of Ill.

[73] Assignee: International Harvester Company, Chicago, Ill.

[22] Filed: June 29, 1973

[21] Appl. No.: 375,192

[52] U.S. Cl. ..... 165/51; 55/268; 180/68 R

[51] Int. Cl.[2] ..... F01P 3/04

[58] Field of Search ..... 165/77, 51; 62/243, 4; 55/277, 290, 404, 268; 180/68 R

[56] References Cited

UNITED STATES PATENTS

| | | | |
|---|---|---|---|
| 3,334,704 | 8/1967 | Gehrke et al. | 180/68 R |
| 3,630,003 | 12/1971 | Ashton | 55/268 |
| 3,834,478 | 9/1974 | Alexander et al. | 165/77 |
| 3,837,149 | 9/1974 | West et al. | 55/290 X |

FOREIGN PATENTS OR APPLICATIONS

| | | | |
|---|---|---|---|
| 579,119 | 7/1959 | Canada | 165/77 |

*Primary Examiner*—Wendell E. Burns
*Assistant Examiner*—Theophil W. Streule, Jr.
*Attorney, Agent, or Firm*—F. David AuBuchon; Floyd B. Harman

[57] ABSTRACT

A dual hinge mounting for both a rotary air screen unit of the blanking type and its associated condenser or other heat-radiating core, and by means of which the screen unit and core may be swung to accessible positions for servicing in situ. The screen unit and core are individually pivoted on separate axes and, in combination with their hinge connections and a connecting strap between them, establish an articulated parallelogram-like linkage arrangement whereby they move in unison to and from their servicing positions. A novel concealed dual latch arrangement which holds the screen unit in its operative position is accessible through a pair of hand holes in the mounting.

2 Claims, 6 Drawing Figures

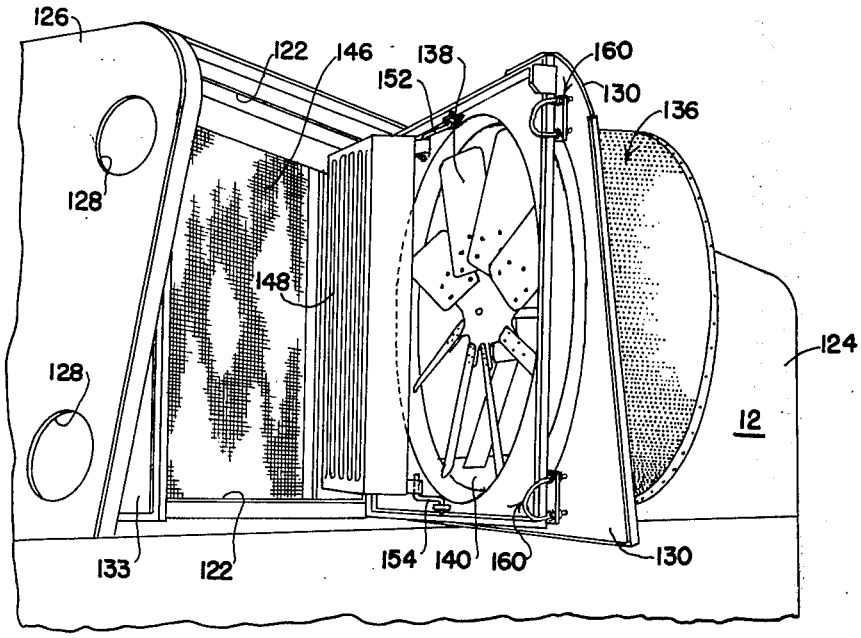

SWINGABLE ROTARY SCREEN

The improved rotary air screen unit or device comprising the present invention has been designed for use primarily in connection with the air cooling sytems of an internal combustion engine which is associated with an agricultural implement such as a harvesting combine. The invention is however capable of other uses and the present rotary air screen device may, if desired, with or without modification, be employed in connection with the cooling systems of all manner of combustion engines, whether the same be automotive or stationary. Irrespective of the particular use to which the invention may be put, the essential features thereof remain substantially the same.

The invention is particularly concerned with rotary air screen devices of the blanking baffle type which is widely used in connection with harvesting combines and wherein the screen is in the form of a rotary cup-shaped cylindrical member which is driven by the air current derived from the engine fan, and the device carries an internal baffle which, in effect, blanks off a part of the surface of the screen so as to create a pressure drop at the blanked off region, to the end that foreign particles such as dust or the like which accumulate on the screen during rotation thereof will drop from the screen when they pass beneath the blanked off area.

Rotary air cleaning screens of the type under consideration, when used in connection with a harvesting combine, usually perform the dual service of cleaning the cooling air which passes through and around both the combustion engine, water radiator and the air conditioning system condenser core, these two heat exchange devices being mounted in the vicinity of the opening across which the rotary screen unit extends. Heretofore, such arrangements have beeen difficult to service in that it is necesary to remove the rotary screen proper so that the operator may reach through the framework opening to gain access to either the radiator or the condenser core. Where only the screen requires attention it must be removed from its installed position.

The present invention is designed to overcome the abovenoted limitation that is attendant upon the construction and use of present day rotary screen units and, toward this end, the invention contemplates the provision of a pivoted screen support which is of dorr-like construction and is hingedly connected to one edge of the framework opening so that it may swing about the hinge axis between an inner "closed" position wherein the screen registers with the framework opening, and an outer "open" where it swings away from the framework and exposes the inner side of the screen and its associated functional adjuncts. The invention further contemplates a separate pivotal mounting for the condenser core and a linkage connection between the door-like support and condenser core causes the latter to move outwardly to an exposed position at the same time that the support and its associated rotary screen are moved to their outer position. To avoid inadvertent or accidental movement of the support to its open position, a novel concealed latch mechanism which is disposed within the combine framework opening is accessible through a pair of hand holes for purposes of release.

The provision of a rotary air screen device such as has briefly been outlined above, and possessing the stated advantages, constitutes the principal object of the present invention. Other objects and advantages of the invention will readily suggest themselves as the following description ensues.

In the accompanying two sheets of drawings forming a part of this specification, one illustrative embodiment of the invention has been shown.

In these drawings:

FIG. 1 is a side elevational view of an axial flow-type combine to which the present rotary air screen device is applied, a major portion of one side wall being removed to reveal the crop-gathering means, the crop-feeding means, the crop-impelling means, the axial threshing and separating means, the grain cleaning and handling means, and the residue discharge means, the view illustrating generally the positional relationship of the engine and its associated rotary air screen;

Figure 1:
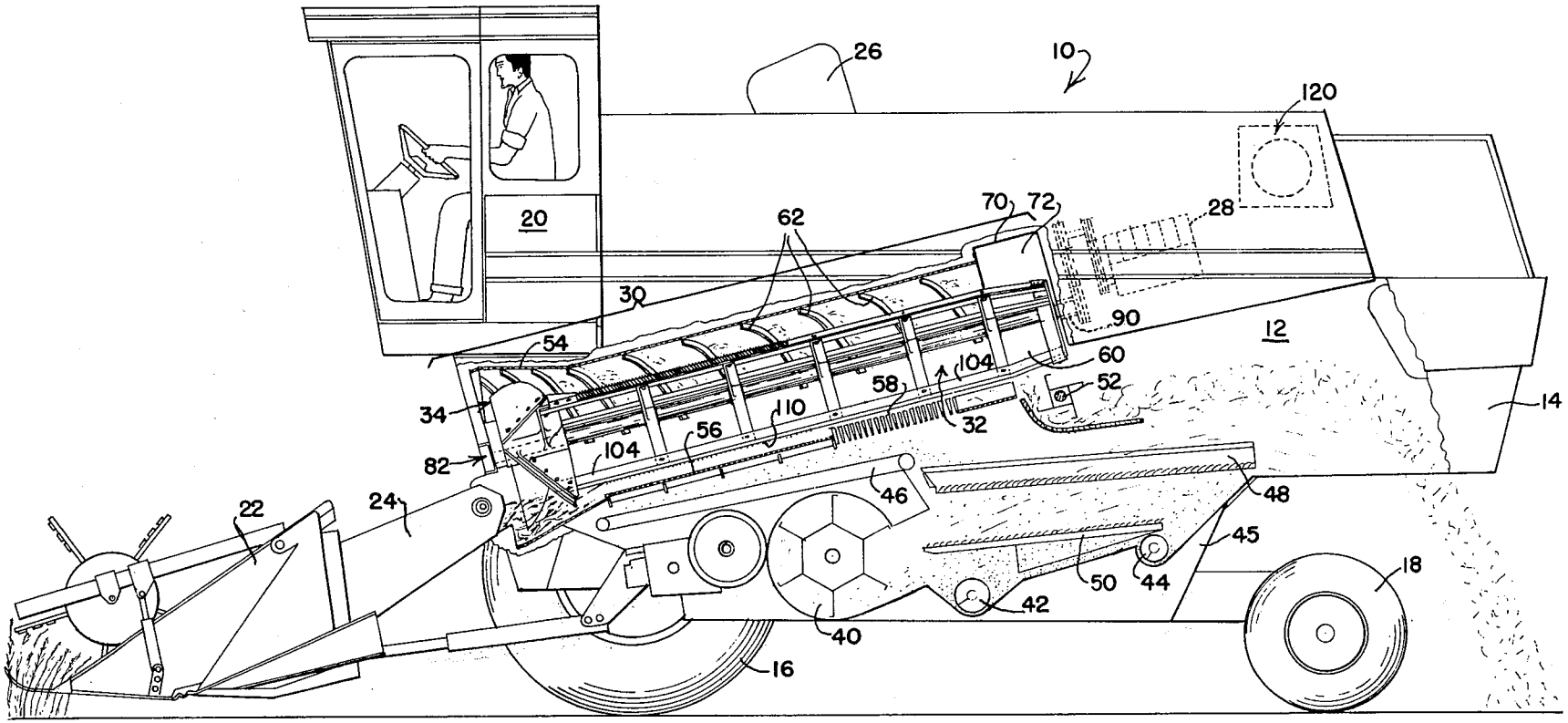

Referring now to the drawings in detail and in particular to FIG. 1, an axial flow-type combine is designated in its entirety by the reference numeral 10, the combine being of the general type shown and described in U.S. Pat. No. 3,481,342, granted on Dec. 2, 1969 and entitled "Axial Flow-type Combine." The combine 10 involves in its general organization a chassis or body portion 12 having vertical side walls 14, the body portion being supported by a pair of relatively large drive wheels 16 in the front region of the combine, and a pair of steerable or dirigible wheels 18 at the rear of the combine. The combine further includes an operator's platform and cab 20, a crop-gathering header 22, a feeder 24, a grain elevator 26 and an engine 28. A grain tank (not shown) is enclosed within the walls of the body portion 12.

As in the case in connection with axial flow-type combines of the character under consideration, the axial threshing and separating means are embodied in a single unit in the form of an elongated and generally cylindrical member 30 in the form of a rotor casing having a rotor 32 mounted therein. The forward end of the rotor 32 carries a vaned impeller 34 of the helix type. Other conventional components not specifically related to the present invention, and which are more or less schematically disclosed herein, are the blower 40, grain auger 42 leading to the aforementioned grain elevator 26, and a tailings auger 44, these components being enclosed within a lower casing section 45 beneath the chassis or body portion 12. Enclosed beneath the cylindrical rotor casing and within the body portion 12 is an elongated generally flat endless conveyor which received separated grain from the concave and grate sections of such member and conducts such grain rearwardly for discharge onto a chaffer sieve 48. Such sieve is reciprocated in a fore and aft direction so as to pass grain and tailings to a grain sieve 50 which also is reciprocated to separate the grain from the tailings so that the grain passes through such sieve and into the grain auger 42 while the tailings are delivered rearwardly to the tailings auger 44. The grain in the auger 42 is delivered by elevator means (not shown) to the grain tank, while the tailings are returned to the rotor casing 30 by elevator means (likewise not shown). A terminal beater 52 which is disposed beneath the rear end of the rotor casing 30 prepares a straw residue for discharge from the combine rearwardly thereof.

Still referring to FIG. 1, the elongated cylindrical rotor casing 30 extends along the longitudinal axis of the combine 10 and the forward end thereof is provided with a frusto-conical transition section 54 which is so termed because it represents a funnel-like entrance mouth by means of which material that is fed rearwardly from the feeder 24 in the form of a relatively wide mat is shrunk, so to speak, and caused to enter the remaining rearward portion of the rotor casing for threshing and separating functions which are performed within the casing upon the material.

The impeller 34 is provided with a vane arrangement which closely mates with the inner frusto-conical surface of the transition section 54. The material which enters the truly cylindrical portion of the casing 30 is processed as it travels forwardly, the threshed grain escaping from the casing through the apertured bottom which is made up of a concave 56 and a grate 58. The straw and other waste material is conducted rearwardly from the separating region of the casing 30 and enters an expansion chamber 72 which exists by reason of a discharge chute 70 that opens downwardly and provides a straw discharge outlet 60 in the lower region of the casing 30 at the extreme rear end thereof. The rotor 30 is journalled for operation within the casing 30 and is provided with an axial rotor shaft 90 which is supported at its forward end in a transverse bar 82 forming a part of the chassis 11. Rotor blades 104 having rasp bars 110 extend longitudinally and are carried on spiders mounted on the rotor shaft 66. Helical transport fins 62 on the upper surface of the casing 30 function to index the material axially through the casing. The rotary air screen device 120 of the present invention appears in dotted lines in FIG. 1 since it is disposed on the right hand side of the combine.

The arrangement of parts thus far described, with the exception of the rotary air screen device 120, is purely conventional and no claim is made herein to any novelty associated with the same, the novelty of the present invention residing rather in the construction of such device 120 and the manner in which it may be manipulated.

Figure 3:
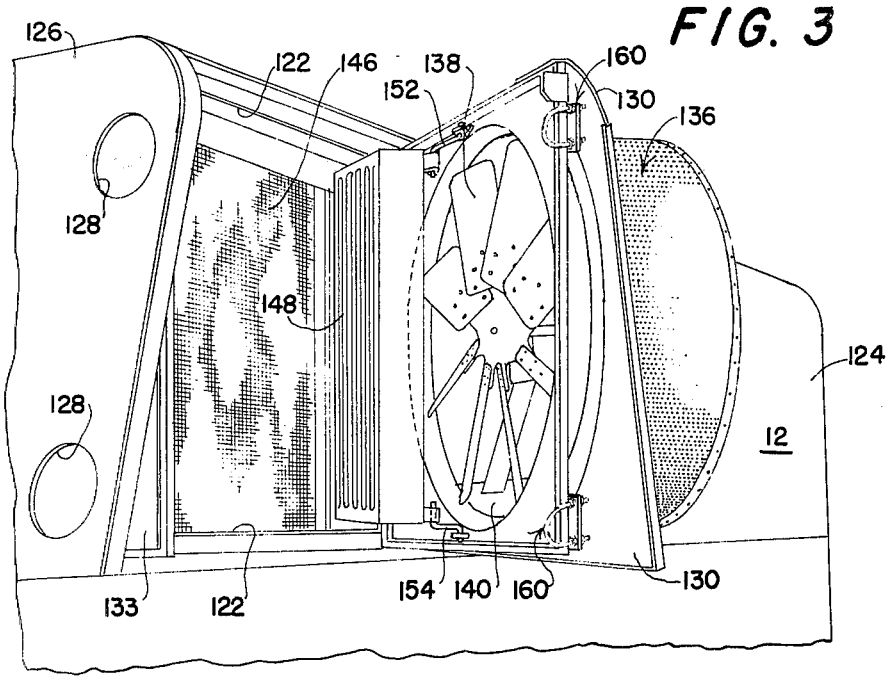
FIG. 3 is a perspective view similar to FIG. 2, showing the rotary air screen device in its "open" position.
Figure 2:
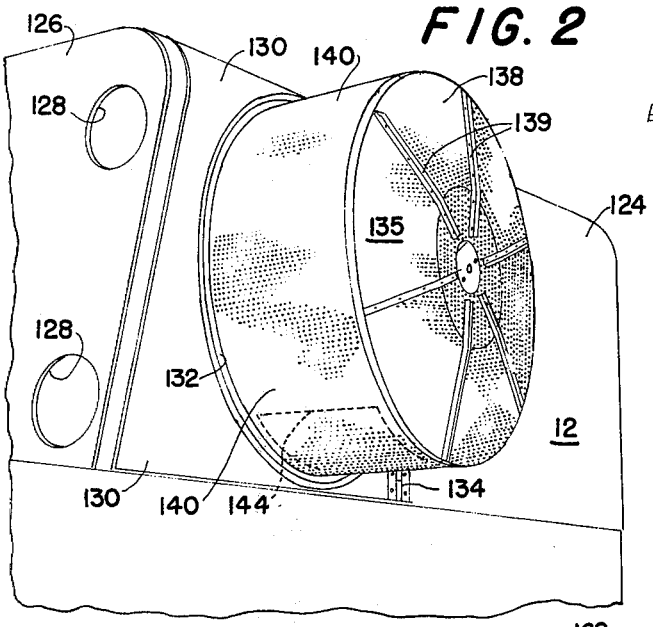
FIG. 2 is a fragmentary side perspective view of the rotary air screen device, showing the same installed upon the combine and in its operative position.
Figure 4:
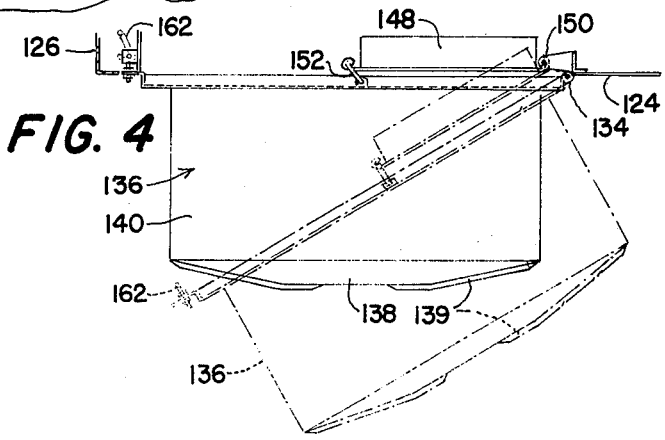
FIG. 4 is a reduced top plan view, largely schematic in its representation, of the structure shown in FIG. 2.

Referring now to FIGS. 2, 3 and 4, the rotary air screen device 120 of the present invention is adapted to be installed in a generally rectangular opening 122 which is provided in the right hand side wall 124 of the combine chassis 12 near a rearwardly facing wall 126. A pair of hand holes 128 are formed in the wall 126 and serve a purpose that will be made clear presently. A door or panel 130 having a circular opening 132 therein fits within the opening 122 and is adapted to close against a jamb 133 (FIG. 3), the door being hingedly connected by a piano-type hinge 134 (FIG. 2) which is coextensive with the front vertical edge of the opening 122.

Operatively installed within the opening 132 and projecting outwardly therefrom is a rotary screen assembly 135 including a screen proper 136, the screen being of generally cup-shape configuration and embodying a circular outer wall 138 which is provided with radial reinforcing ribs 139, and a cylindrical wall 140. This screen unit 135 per se is of the general type shown and described in U.S. Pat. No. 3,475,883, granted on Nov. 4, 1969 and entitled "Rotary Screen Seal." The details of such screen unit 135 have not been fully disclosed herein and for a full understanding thereof reference may be had to such patent which, by reference thereto is hereby incorporated in and made a part of the present application insofar as its disclosure is consistent therewith. For purposes of description herein it is deemed sufficient to state that a fixed supporting structure within the confines of the screen serves to rotatably support the latter so that its rim portion closes the opening 132. A series of fan-like blades 138 are secured to the screen for rotation in unison therewith and are affected by the inrush of air through the opening 32 incident to the fan blades which are associated with the engine 28 so that when the engine is in operation the screen 136 is constrained to rotate.

The supporting structure within the screen also serves fixedly to support a baffle sheet 140 in the shape of a cylindrical arc near the bottom of the screen, the function of the baffle being to stop the flow of air through a segment of the screen and thus permit dust and debris adhering to the outer surface of the screen to fall by gravity from the screen.

Mounted within the combine body portion 12 a short distance behind the opening 122 is the usual heat exchange radiator 146 for the water system of the engine 28 while the heat exchanger or core 148 normally assumes a position immediately in front of the radiator 146 but is adapted to automatically swing outwardly through the opening 122 when the panel 130 is moved to its outer position. Accordingly, the outside rear vertical corner edge of the core 148 is pivotally connected by a hinge 150 (FIG. 4) to a fixed part of the combine so that the core may swing outwardly from the full line position of FIG. 4 to the dotted line position. The outside rear corner edge of the core is connected to the panel 130 by upper and lower floating tie rods 152 and 154 (FIGS. 3 and 4). Thus it will be noted that the condenser core 148 and panel 130, in combination with the tie rods 152 and 154 (considered collectively), establish in effect a four-bar linkage wherein the portion of the combine framework between the hinges 134 and 150 (FIG. 4) constitute a fixed link, the core and panel constitute a pair of swinging links, while the tie rods 152 and 154 (considered collectively) constitute a free floating link.

Considering such four-bar linkage, and referring to FIG. 4, it will be observed that when the panel 130 is in its closed position, the four-bar linkage described above is nearly collapsed so that the panel and core assume positions of close proximity to each other. When the panel 130 is extended to its dotted line position, the four-bar linkage defines a trapezoid where the core and panel are parallel and spaced apart. In this outer position of the panel and core, both the interior of the screen 136 and the core are readily accessible for servicing.

Figure 5:
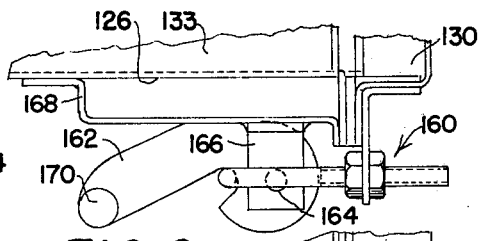
FIG. 5 is an enlarged plan view of a latch mechanism employed in connection with the invention.
Figure 6:
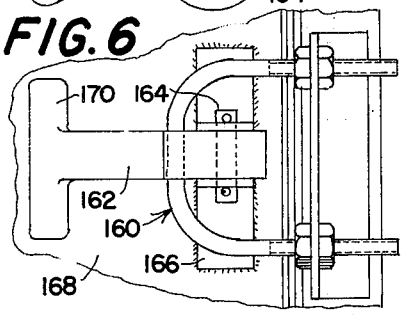
FIG. 6 is a side elevational view of the structure shown in FIG. 5.

Means are provided for latching the panel in its closed position across the opening 122, such means comprising upper and lower clevises 160 which are fixedly attached to the outer edge region of the panel 130 and which cooperate with respective latch elements 162 (FIGS. 5 and 6) of hook-shaped construction and which are pivoted near their hooked ends on vertical pins 164 carried in bracket 166 welded to plates 168 which are provided on the jamb 133. Handles in the form of T-heads 170 on the distal ends of the latch elements 162 are accessible through the hand holes 128 for manipulation.

When it is desired to service one or more of the three components, namely the radiator 146, core 148 or screen 135, access to these components may be had by reaching through the hand holes 128 and effecting unlatching of the panel by releasing the clevises from the latch elements 162, after which the latter may be swung to its open position, thus exposing such components for attention. After servicing operations are complete, the panel may be restored to its operative closed position and the latch elements 162 caused to hook over the medial portions of the clevises 160, the latching operations being effected through the hand holes 128.

The invention is not to be limited to the exact arrangement of parts shown in the accompanying drawings or described in this specification as various changes in the details of the construction may be resorted to without departing from the spirit of the invention. For example, although the panel 130 has been shown and described herein as being swingable about a vertical axis, it is within the purview of the invention to apply the hinge 134 to a horizontal edge of the opening 122 so that the panel may be operated by raising or lowering the same. Therefore, only insofar as the invention has particularly been pointed out in the accompanying claims is the same to be limited.

What is claimed is:

1. In a vehicle having a body provided with a generally rectangular air intake opening, said vehicle embodying an internal combustion engine having a fixed heat exchange radiator, and an air conditioning system including a movable heat exchange condenser core, said radiator being fixedly mounted within said body in the vicinity of said opening and said core being normally disposed outwardly of the radiator immediately behind said opening and within said body, a generally rectangular panel having one edge thereof hingedly connected to said body and capable of swinging movement between a normally closed position wherein it covers the opening and an open extended position wherein it uncovers the opening, said core being pivotally mounted on said body for swinging movement between its normal position and an extended position wherein it projects outwardly of said opening, said panel being formed with a relatively large central opening therein, a rotary air screen of the blanking baffle type carried by said panel and cooperating with said central opening, and means operatively connecting said panel and condenser core for swinging movement in unison between their normal and extended positions, said means comprising at least one tie rod pivotally connected at one end to the panel and at the other end to the outer edge region of the core, and wherein the panel and condenser core are pivoted to the vehicle body for swinging movement about respective closely spaced parallel axes and the portion of the body which extends between said axes, in combination with said core, panel and tie rod, define, in effect, an elongated four-bar linkage which, when the panel and core are in their normal positions is substantially collapsed, and when the panel and core are extended define a trapezoid.

2. A vehicle as set forth in claim 1, wherein cooperating releasable latch means are provided on said panel and body and within the latter for maintaining the former in its normally closed position, and a hand hole is formed in the body for rendering said latch means accessible.

* * * * *